US010492249B2

(12) United States Patent
McRae

(10) Patent No.: US 10,492,249 B2
(45) Date of Patent: Nov. 26, 2019

(54) ELECTROLUMINESCENT ORNAMENTS AND DISPLAY SYSTEMS

(71) Applicant: Michael M McRae, Ormond Beach, FL (US)

(72) Inventor: Michael M McRae, Ormond Beach, FL (US)

( * ) Notice: Subject to any disclaimer, the term of this patent is extended or adjusted under 35 U.S.C. 154(b) by 0 days.

(21) Appl. No.: 13/987,202

(22) Filed: Jul. 10, 2013

(65) Prior Publication Data

US 2016/0003447 A1 Jan. 7, 2016

Related U.S. Application Data

(60) Provisional application No. 61/741,006, filed on Jul. 10, 2012.

(51) Int. Cl.
*H05B 33/00* (2006.01)
*F21V 23/02* (2006.01)

(52) U.S. Cl.
CPC ..... *H05B 33/00* (2013.01); *F21V 23/02* (2013.01)

(58) Field of Classification Search
CPC .. F21L 4/00; F21W 2121/00; F21W 2121/04; F21S 9/02; H05B 33/00; H05B 33/02; A47G 33/06; A47G 33/08; A47G 2033/0827; F21V 23/02; F21V 9/00; F21V 9/30; F21V 9/32; F21V 9/38
USPC ..... 362/157; 345/87, 102
See application file for complete search history.

(56) References Cited

U.S. PATENT DOCUMENTS

| | | | | |
|---|---|---|---|---|
| 2,733,367 | A * | 1/1956 | Gillson, Jr. | H05B 33/20 116/DIG. 35 |
| 3,037,137 | A * | 5/1962 | Motson | H05B 33/20 250/458.1 |
| 4,458,177 | A * | 7/1984 | Hunter | H05B 33/145 252/301.4 P |
| 4,680,461 | A * | 7/1987 | Boit | H01J 29/182 250/214 VT |
| 4,733,488 | A * | 3/1988 | Yokoyama | A47G 33/08 313/498 |
| 5,326,935 | A * | 7/1994 | Yamaguchi | H01B 7/0241 174/110 FC |
| 8,106,578 | B2 * | 1/2012 | Brown | H01J 1/63 313/501 |
| 2006/0158458 | A1 * | 7/2006 | Kojima | G09G 3/3233 345/592 |
| 2008/0136314 | A1 * | 6/2008 | Brown | H01J 1/63 313/503 |
| 2009/0080177 | A1 * | 3/2009 | Richman | G09F 13/04 362/84 |

(Continued)

*Primary Examiner* — Bao Q Truong
(74) *Attorney, Agent, or Firm* — Ellenoff Grossman & Schole LLP; James Smedley; Alex Korona

(57) ABSTRACT

Electroluminescent holiday lighting systems are provided including electroluminescent ornaments of varying constructions. An ornament shell or base has a layered construction including a base conductor, active conductor, electroluminescent layer and numerous insulation and protective layers. The electroluminescent layer is activated by a controller that selectively applies an activation bias to the ornament to illuminate it under specific conditions. Numerous ornament and lighting system controllers are also provided for controlling electroluminescent lights and displays, some in combination with other lighting technologies such as LED systems.

13 Claims, 15 Drawing Sheets

(56) References Cited

U.S. PATENT DOCUMENTS

2012/0126723 A1* 5/2012 Seo ..... H01L 25/046
315/312

* cited by examiner

ELECTROLUMINESCENT ORNAMENTS AND DISPLAY SYSTEMS

CROSS REFERENCE TO RELATED APPLICATIONS

This application claims priority to and the benefit of U.S. Provisional Patent Application No. 61/741,006 filed Jul. 10, 2012 titled "Electroluminescent Holiday Lighting and Display Systems" which is incorporated by reference herein in its entirety.

This application is also related to the following pending patent applications all of which are incorporated herein by reference in their entirety:

U.S. patent application Ser. No. 12/930,892 titled APPARATUS AND METHOD FOR CONTROLLING LED LIGHT STRINGS filed Jan. 19, 2011 (hereinafter "By-Pass");

U.S. patent application Ser. No. 13/694,755 titled APPARATUS AND METHOD FOR CONTROLLING LED LIGHT STRINGS filed Dec. 31, 2012 (hereinafter "DC Rectification");

U.S. patent application Ser. No. 13/694,754 titled APPARATUS AND METHOD FOR CONTROLLING A MULTICOLORED LED LIGHT STRING filed Dec. 31, 2012 (hereinafter "All Holiday").

U.S. patent application Ser. No. 13/986,061 titled METHOD AND APPARATUS FOR CONTROLLING MULTICOLORED LIGHT STRINGS filed Mar. 28, 2013 (hereinafter "Rotary Switch"); and U.S. patent application Ser. No. 13/986,063 titled METHOD AND APPARATUS FOR PROVIDING POWER TO LIGHT STRINGS filed Mar. 28, 2013 (hereinafter "Power Boost").

STATEMENT REGARDING FEDERALLY SPONSORED RESEARCH OR DEVELOPMENT

Not applicable.

BACKGROUND OF THE DISCLOSURE

1. Field of the Invention

The invention is directed to ornaments, lights and lighting system that involve electroluminescent lighting techniques, particularly with respect to providing ornaments and control systems in connection with holiday lighting systems.

2. Description of the Prior Art

Low voltage, low power lighting systems, including lights, light strings, lighted ornaments and overall lighted displays, are becoming increasingly popular as holiday decorations. Numerous low voltage, low power lighting technologies exist for providing such lighting, including LED-based, phosphorescent, luminescent and electroluminescent lights. However, among these, electroluminescent lighting is a relatively nascent commercial technology; one providing a low power consumption lighting alternative that has yet to be commercially realized in holiday lighting systems. No commercial systems are known to date that use electroluminescent lights that are specifically fabricated for, incorporated into and controlled within holiday ornaments or displays.

Following the introduction of electroluminescent lighting within holiday lighting displays, it becomes necessary to provide associated controllers. The diversity of lights within modern lighting displays often require that a plurality of illumination types be supported, i.e. both bright lights, such as LEDs or mini-lights, and other softer glowing lights, such as those found with electroluminescent constructions and arrangements. Further, modern lighting system controllers must accommodate a plurality of different low voltage requirements to accommodate the various low power lighting types within decorative holiday displays. Finally, methods for interconnecting, coordinating and synchronizing these disparate types of lighting systems containing different types of lights are needed, but not yet commercially realized.

SUMMARY OF THE INVENTION

In one particularly preferred embodiment of the present invention, the invention is an ornament includes a shell having a plurality of coatings applied to the shell, the plurality of coatings being layered on the shell and including a base conductor layer, an active conductor layer, and an electroluminescent layer between the base conductor layer and the electroluminescent layer; and an electronics platform having a DC/AC converter and a DC power supply, the DC power supply coupled to the DC/AC converter having two leads electrically coupled to the based conductor layer and the active conductor layer, the electroluminescent layer being illuminated when the DC power supply is in an active state. In a several preferred aspects, the DC power supply includes a battery; and the plurality of coatings is covered by an outer protective coating encasing the plurality of coatings between the shell and the outer protective coating; and the electroluminescent layer is further includes a plurality of electroluminescent materials, each of the plurality of electroluminescent materials displaying a different color.

BRIEF DESCRIPTION OF THE DRAWINGS

The accompanying drawings, which are incorporated in and constitute part of this specification, illustrate embodiments of the invention and together with the description, serve to explain the principles of the invention. The embodiments illustrated herein are presently preferred, it being understood, however, that the invention is not limited to the precise arrangements and instrumentalities shown, in which.

DETAILED DESCRIPTION

To facilitate a clear understanding of the present invention, illustrative examples are provided herein which describe certain aspects of the invention. However, it is to be appreciated that these illustrations are not meant to limit the scope of the invention, and are provided herein to illustrate certain concepts associated with the invention.

It is also to be understood that the present invention or portions thereof may be implemented in various forms of hardware, software, firmware, special purpose processors, or a combination thereof. Preferably, the electronic processing portions of the present invention are implemented in hardware possibly containing software as a program tangibly embodied on a program storage device. The program may be uploaded to, and executed by, a machine comprising any suitable architecture. Preferably, the machine is implemented on a computer platform having hardware such as one or more central processing units (CPU), a random access memory (RAM), and input/output (I/O) interface(s). The computer platform also includes an operating system and microinstruction code. The various processes and functions described herein may either be part of the microinstruction code or part of the program (or combination thereof) which is executed via the operating system. In addition, various other peripheral devices may be connected to the computer platform such as an additional data storage device and a printing device.

It is to be understood that, because some of the constituent system components and method steps depicted in the accompanying figures are preferably implemented in software, the actual connections between the system components (or the process steps) may differ depending upon the manner in which the present invention is programmed. Specifically, any of the computers or devices may be interconnected using any existing or later-discovered networking technology and may also all be connected through a lager network system, such as a corporate network, metropolitan network or a global network, such as the internet.

Those of skill in the art will appreciate that while the description provided below specifically recites electroluminescent lights, ornaments, light strings, and lighting systems, the general teachings of the invention are applicable to other similarly constructed and operated lighting technologies, such as phosphorescent lighting and luminescent lighting.

Figure 1:
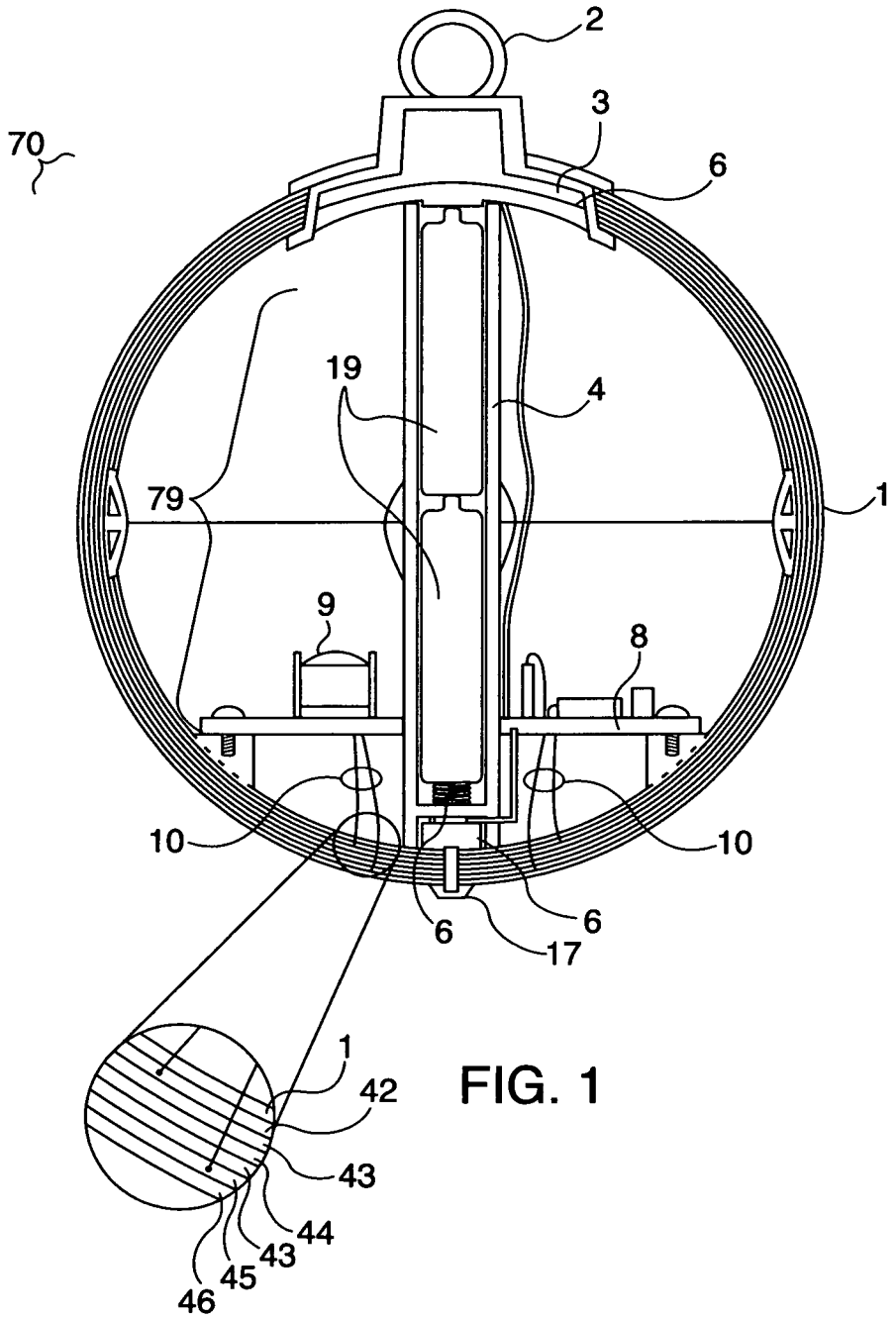
FIG. 1 shows a cross sectional, side view of a lighted ornament according to one embodiment of the invention.

FIG. 1 shows a cross sectional side view of an enclosed ornament 70 according to one embodiment of the present invention. The ornament of FIG. 1 is designed for independent hanging display and includes a structurally supportive case or shell 1 with an opening at the top. The shell opening is capped-off at the top by removable hanger base 3 having hanger 2 coupled to the exterior of the hanger base and configured for the purpose of hanging the ornament. A plurality of coatings or layers 42, 43, 44, 45 and 46 are disposed on the shell 1. Although shown on the outside of shell 1 in FIG. 1, the coatings may equivalently be deposited in the inner surface of the shell, either instead of or in addition to being deposited on its outer surface.

In the plurality of coatings shown, a base conductor layer 42 is deposited directly on shell 1 with a thin clear insulating coating 43 deposited on top of that. The electroluminescent (hereinafter EL) layer 44 is then deposited on insulating coating 43, on top of which a second insulating coating 43 is applied. An active (second) conductor layer 45 is then deposited on second insulating layer 43. Second conductor layer 45 is preferably a thin, metallic, electrically conductive layer or a fine wire weave. Finally, a top clear coating 46 is deposited on the top of the second insulating layer 43 to finish the plurality of layered coatings. Top coating 46 may serve as either or both functions of physically protecting and electrically insulating the underlying coatings. It should be appreciated that in alternative arrangements, one or more insulating coatings or bonding layers may be deposited between any of the above-mentioned layers so as to improve layer adhesion and/or the electrical functional characteristics of the ornament and its EL layer.

Within shell 1 is an electrical platform 79 that includes a plurality of electrical components including a DC power source, such as batteries 19. Batteries 19 are physically mounted in battery holder 4 that is preferably coupled to hanger base 3 for ease of removal and battery replacement. Battery holder 4 is coupled to DC power contacts and leads 6 for electrical connection to circuit board 8, thereby providing electrical power to the circuit board. Push button switch 17 is optionally included in series between the DC power contacts and leads and circuit board 8 so as to selectively turn power on and off to circuit board 8. Circuit board 8 includes various electrical circuitry physically mounted and electrically coupled thereon, including a DC/AC converter 9 (e.g. a crystal oscillator). The output of the DC/AV DC/AC converter provides an EL control or signal bias (i.e. AC signaling or electrifying power) on leads 10 within the ornament. Leads 10 are in turn coupled to the base conductor layer 42 and second conductor layer 45.

Figure 3:
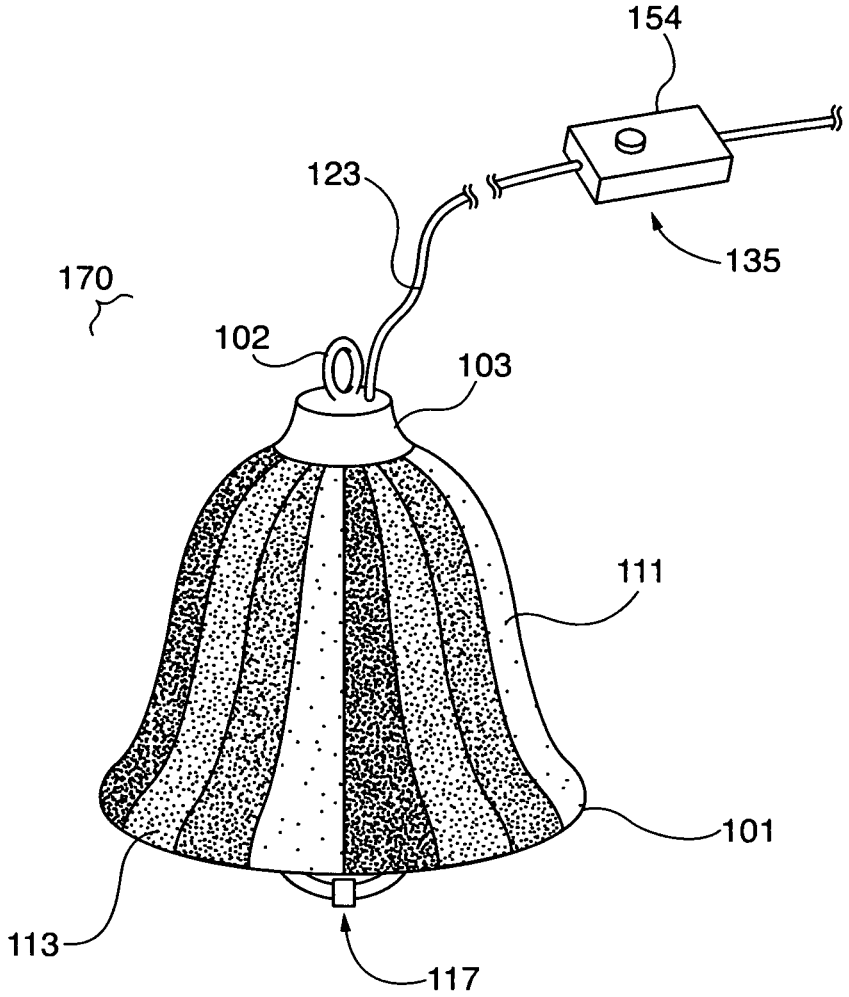
FIG. 3 shows an external view of another lighted ornament coupled to a controller according to one embodiment of the invention.

In other embodiments of this ornament, as provided in FIG. 3, DC electrical power may be fed to the electrical platform 79 via a wiring harness 123. In this arrangement the DC power distributed via the harness is provided directly to the ornament without the need for internal batteries and the DC power contacts and leads 6 are mechanically and electrically coupled to the circuit board 8 and the appropriate power leads in the wire harness.

In operation, DC power is provided through contacts and leads 6 and on to circuit board 8 and its coupled components. Relevant electrical circuitry, including but not limited to the DC/AC converter, converts the DC power to an AC biasing signal that is output from the DC/AC converter through leads 10 and provided across the base conductor and active conductor layers of the ornament. An AC electric field is created between these the two conductor layers resulting in the biasing of the EL material within EL layer 44. This causes the material composing that layer to illuminate the shell of the ornament.

Figure 2:
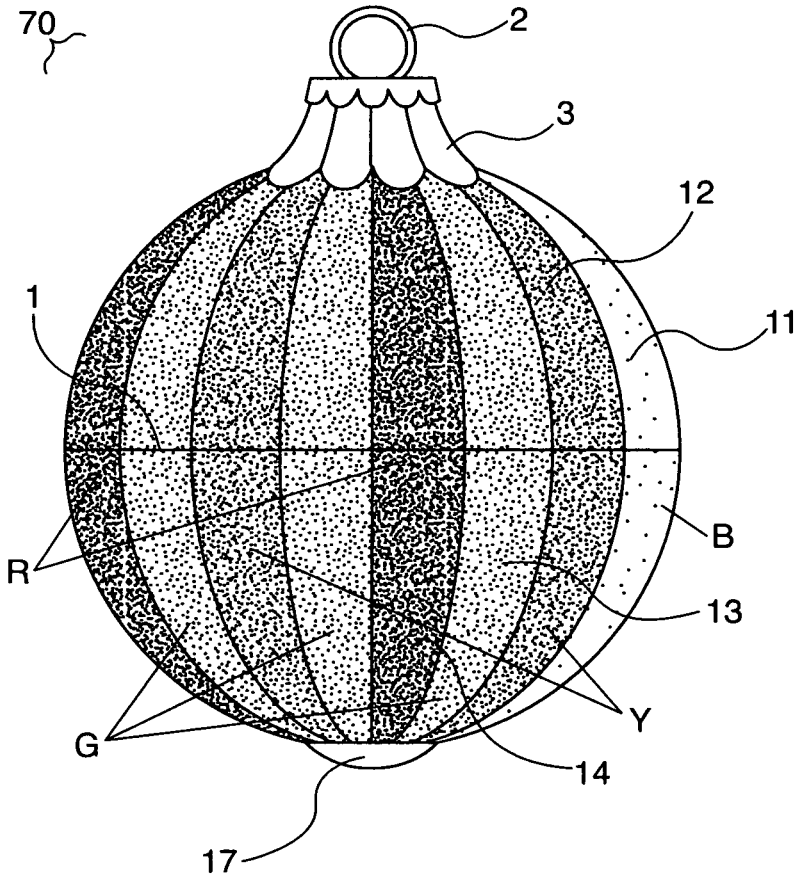
FIG. 2 shows an external view of a lighted ornament according to one embodiment of the invention.

FIG. 2 is an exterior view of the EL ball ornament 70 of FIG. 1 with one enhancement: the EL layer 44 has been deposited in different-colored, vertically-oriented, wedge-shaped slices (11, 12, 13, and 14) along the surface of shell 1. Each of the wedge-shaped portions of the EL layer is coated with a different color EL material so that the ornament displays multi-colored facets when illuminated. As shown on the letter labels, the wedge shaped sections 11, 12, 13 and 14 are colored blue, yellow, green and red respectively. In alternative embodiments, the EL layer may be singular in color, e.g. white, while any one or more of the insulating and protective layers 43 and 46 are colored independently and deposited on the shell in vertically-oriented, wedge-shaped slices so as to provide the same effect.

In FIG. 3, a bell-shaped ornament 170 is shown having component parts similar to those in the ball ornaments provided in FIGS. 1 and 2. As mentioned with respect to an alternative embodiment in those Figures, this arrangement permits controller 135 to accept input DC power and provide controlled, pass-through DC power to the circuit board 108 in ornament 170 directly through the hanger top 103 via a wire harness 123. In another embodiment of FIG. 3 (not overtly shown), the electronics platform 179 is removed from within the ornament 170 and is housed within controller 135. In this instance, EL control signal(s) issue from circuit board 108 on leads 110 from within controller 135, pass through wire harness 123 and are presented directly to the base conductor and second conductor within ornament 170 so as to illuminate ornament 170. Various control functions may also be configured within hardware and software contained on the circuit board 108 within controller 135. In exercising such control, DC power is selectively passed to the ornament 170 only under certain conditions. In particular, and as disclosed in the above-related applications, the control functions implemented within controller 135 may include but are not limited to: simple power on/off switching; By-Pass flow-through of activation signaling, Rotary Switch control of signaling, All Holiday multi-color pattern display control. Finally, wireless interface components 154 may also be included in controller 135 so that remote control capability of the ornament and/or entire illumination display system is provided.

Figure 4:
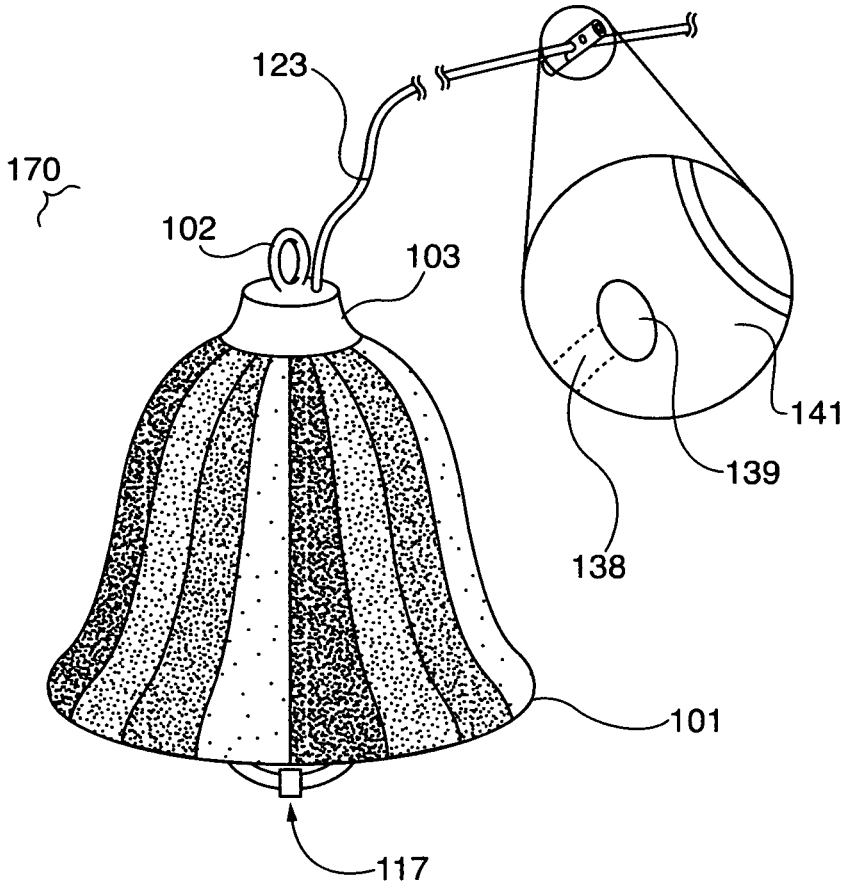
FIG. 4 shows an external view of another lighted ornament coupled to a sensor according to one embodiment of the invention.

FIG. 4 shows an additional ornament control embodiment, specifically an optical transmitter and detector arrangement as provided in the set-out. In particular, optical sensor/receiver 139 is physically coupled to wire harness 123 and electrically coupled to leads 138 within the same, so as to provide signaling to the circuit board 108 from sensors 139. In one physical embodiment, optical sensor 139 is a solid state sensor known as a photo-optic triac. Sensor clip 141 is configured as a part of sensor 139 and is affixed close to another illumination element within the holiday illumination system. The proximate mounting position permits receiver 139 to detect the presence/absence of illumination of nearby lighting elements and/or the color of such illumination. Circuitry on circuit board 108, possibly in connection with software, is configured to provide appropriate control signals to oscillator 109 within ornament 170 upon the detection/non-detection of illumination sources and certain colors thereof.

Figure 5:
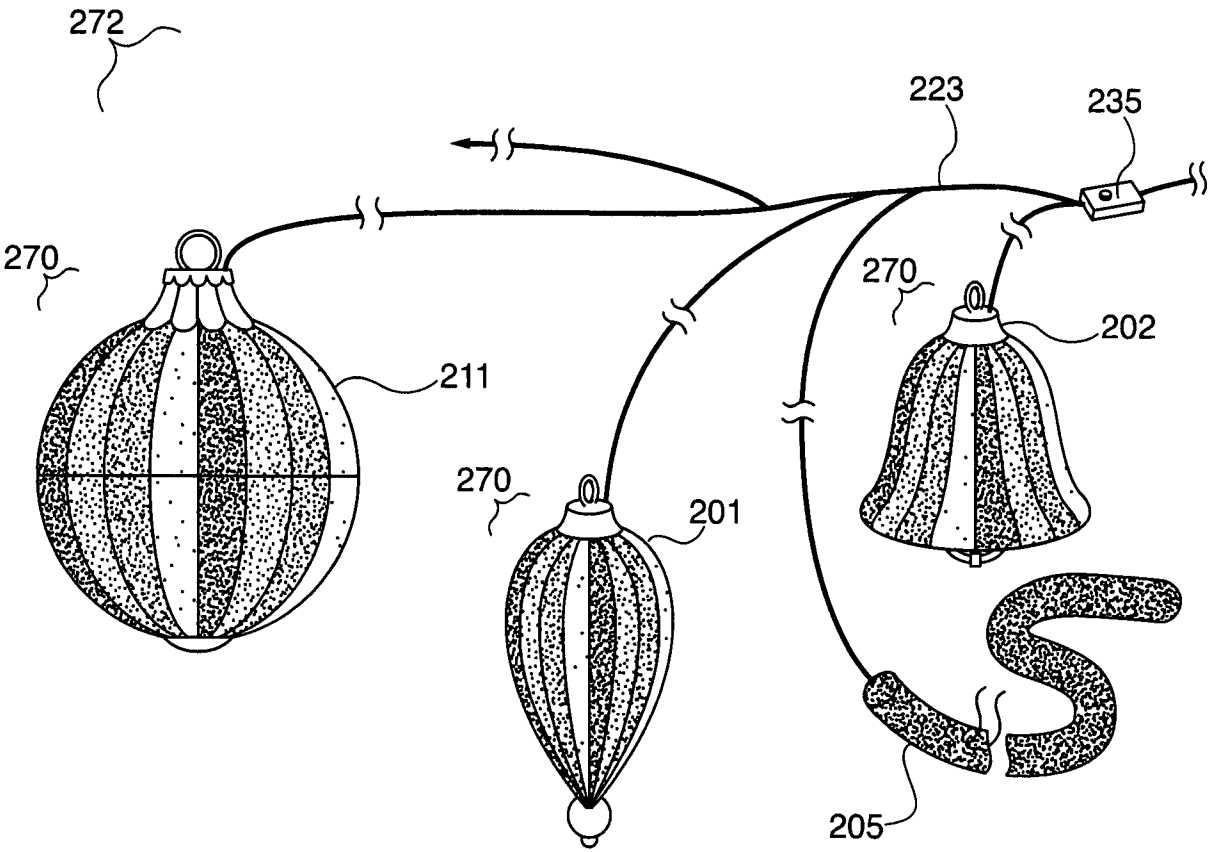
FIG. 5 shows a coupled system of lighted ornaments, which are also coupled to a controller according to one embodiment of the invention.

FIG. 5 shows a holiday illumination system that includes a number of ornaments 270, all interconnected through wire harness 223 and under the common control of controller 235. Controller 235 provides any of the functions recited above in connection with FIGS. 3 and 4 and with respect to the entire holiday illumination system 272.

Figure 6:
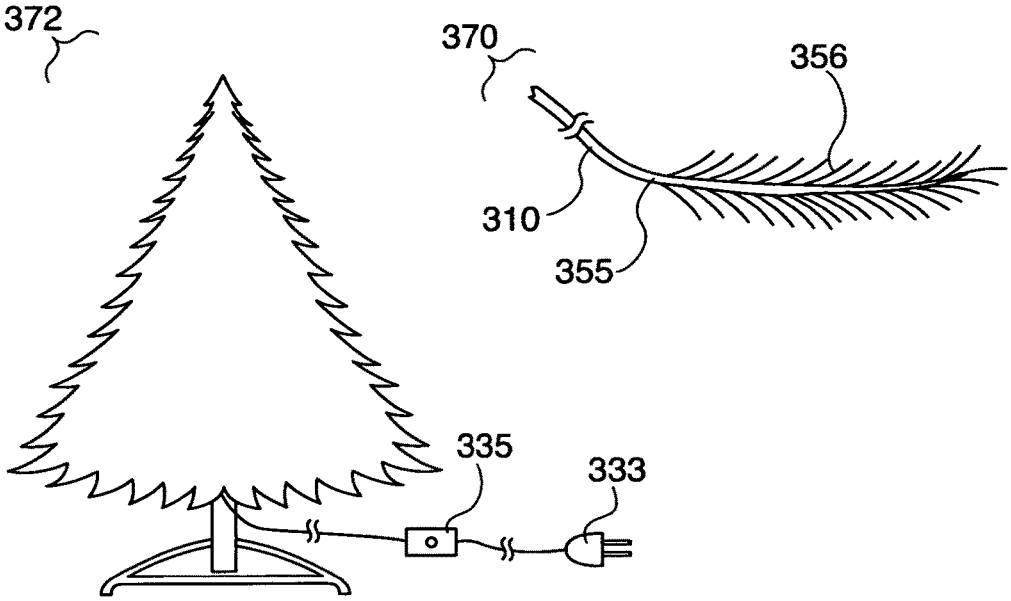
FIG. 6 shows a system of coupled, lighted elements assembled as a holiday tree and which are also coupled to a controller according to one embodiment of the invention.

FIG. 6 shows a prototypical holiday lighting system 372 as a Christmas tree, in which the ornaments 370 are individual branch elements of the tree. The EL Christmas tree receives its AC power from plug 333 which is passed to controller 335. Controller 335 contains an AC/DC rectifier as part of its electronics platform to provide low voltage, low power signals to the circuit board 308 that controls the individual branches (ornaments). Controller 335 provides any of the functions recited above in connection with FIGS. 3 and 4 and with respect to the entire holiday illumination system 372.

In one simple embodiment, tree illumination may be provided by a thin EL rope that is wrapped around the branches and plugged in at the base so as to illuminate the tree. In another embodiment, the controller 335 biases EL control signals 310 for each ornamental branch 355 on which are disposed EL needles 356. Construction variations are described in more detail below, but in one preferred embodiment, the second conductor within each branch or needle can either be wrapped around the branches or incorporated within the branches themselves. In still another embodiment, all the EL biasing leads may be incorporated within the branches so that the needles themselves are again constructed to be EL decorations and constructed as part of the branches. As with the plurality of layers on the shell of FIG. 1, the needles themselves glow.

Figure 7A:
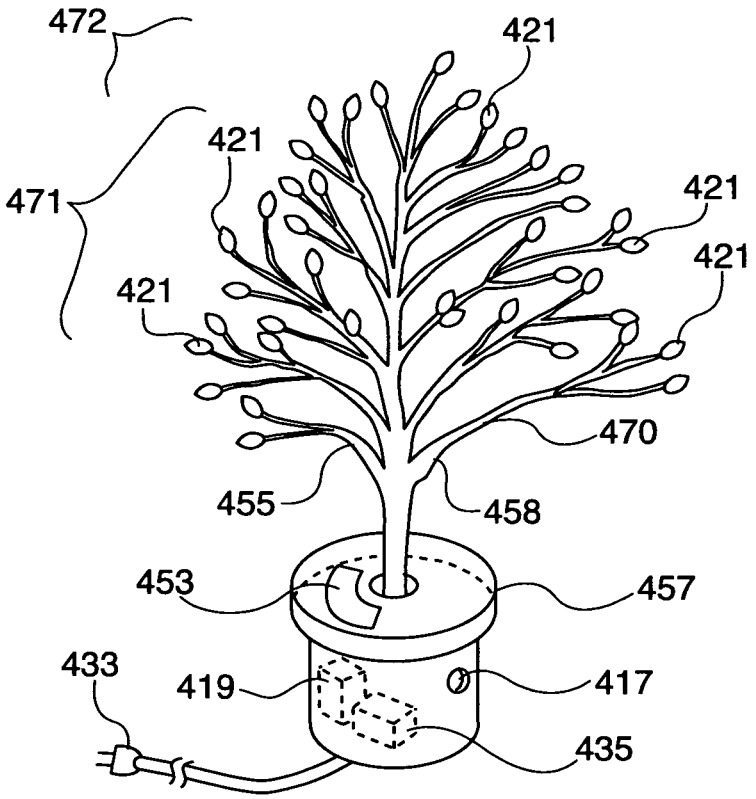
FIGS. 7A-7D show a system of coupled, lighted elements assembled as another type of holiday tree and which are also coupled to a controller according to one embodiment of the invention.

FIG. 7A shows another typical holiday lighting system 472 as a deciduous-like holiday tree, in which the EL ornaments 470 take one of several forms. In one instance, the EL ornaments are wires strung along or around branches 455 or are within the individual branch elements 455 of the tree itself. EL bulb ornaments 471 may also be included at the ends of or anywhere along tree branches 455. In this particular embodiment, the EL lights are combined with LED lighting elements 421 that are also disposed on the holiday tree branches 455. The EL holiday tree receives its AC power from plug 433 which is passed to controller 435. As shown in FIG. 7A, the controller housing is shaped like a pot for accommodating a potted tree and may be environmentally configured for both indoor and outdoor use. Alternative power sources may also be accommodated within controller 435 such as battery 419 and solar collector 453 which, in combination, can act to collect and store energy throughout the day for later illumination of the tree in the evenings. Controller 435 may also contain a controlling switch 417 for providing manual control (e.g. on/off) of the display.

Figure 7B:
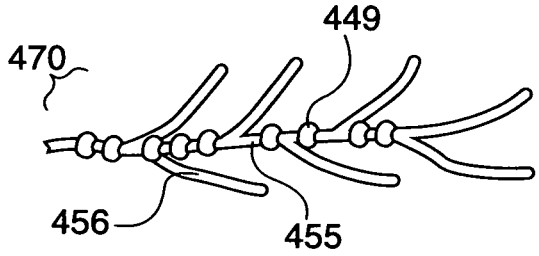
Figure 7C:
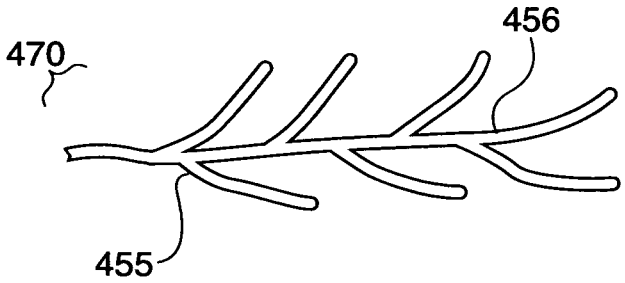
Figure 7D:
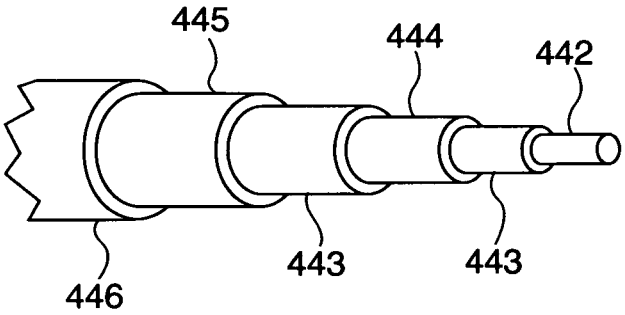

FIGS. 7B-7D show various configurations and arrangements for the EL illumination of the branches 455 of either the Christmas tree 372 of FIG. 6 or the holiday tree 472 of FIG. 7A. The element numbering within FIGS. 7B-7D is provided in correlation with the elements of FIG. 7A for convenience although their applicability to like-numbered elements of FIG. 6 are easily determined. Ornament 470 may be one of several constructions. First, with respect to overall construction, the generalized form of the EL light described in FIG. 1 is maintained as shown in FIG. 7D. In the case of an EL branches, a plurality of coatings or layers 443, 444, 445 and 446 are shown as be deposited on the base conductor 442. Base conductor 442 is first wrapped to form the tree branches and then extended to the needles. Base conductor is then coated with a thin clear insulating coating 443 after which the EL layer 444 is deposited on insulating coating 443. In the case of the conifer tree, FIG. 7B, the EL layer may only be deposited on the needle portions of the branch. In the case of the deciduous tree FIG. 7C, any or all portions of the branch may be coated by the EL layer. In either case, a second insulating coating 443 is applied atop the EL layer, over which an active conductor (second conductor) layer 445 is then deposited on the second insulating layer 443. As with the above-mentioned construction, second conductor layer 445 is preferably a thin, metallic, electrically conductive layer or a fine wire weave. Finally, a top clear coating 446 is deposited on the top of the second insulating layer 443 to finish the plurality of layered coatings. Also, as described previously, it should be realized that in alternative arrangements, one or more insulating coatings or bonding coatings may be deposited between any of the aforementioned layers so as to improve layer adhesion and/or the electrical functional characteristics of the ornament and the EL layer.

For the branch 455 of FIG. 7B, which corresponds more closely with a conifer branch of the Christmas tree of FIG. 6, at least each needle 456 is composed of the construction shown in FIG. 7D and a second conductor connection 449 is made to run down each branch and connect with each needle. Alternatively, the branch itself, apart from the needles, could be made of a composite material that houses the two EL connections within it.

For the branch 455 of FIG. 7C, which corresponds more closely with a tree branch of a deciduous tree, each branch of the tree is itself composed of the construction shown in FIG. 7D and the entire branch glows when illuminated by the EL bias signals within each branch. In either case of FIG. 7B or 7C, connection to the tree trunk is used to provide electrical connection to the base wherein the branches simply "plug in" to make electrical connection.

Figure 8:
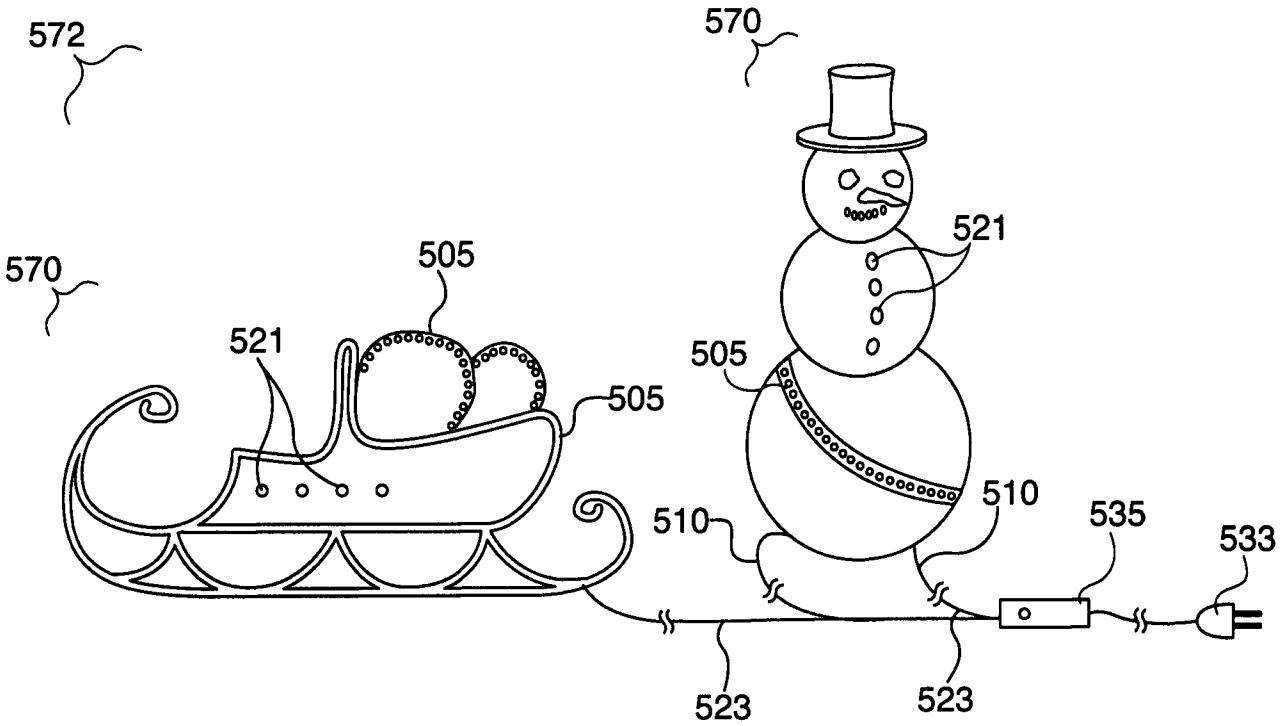
FIG. 8 shows a system of coupled, lighted ornaments which are also coupled to a controller according to one embodiment of the present invention.

FIG. 8 shows another holiday illumination system 572 that includes a number of larger illuminated display ornaments 570, featuring both EL display elements (ropes) 505 and LED display elements (buttons) 521. All display elements are interconnected through wire harness(es) 523 which is also connected to and under the common control of controller 535. Controller 535 provides any of the functions recited above in connection with FIGS. 3 and 4 with respect to the holiday illumination system 572. The overall holiday illumination system receives its AC power from plug 533 which is passed on to controller 523 for distribution on the wire harness(es).

Figure 9:
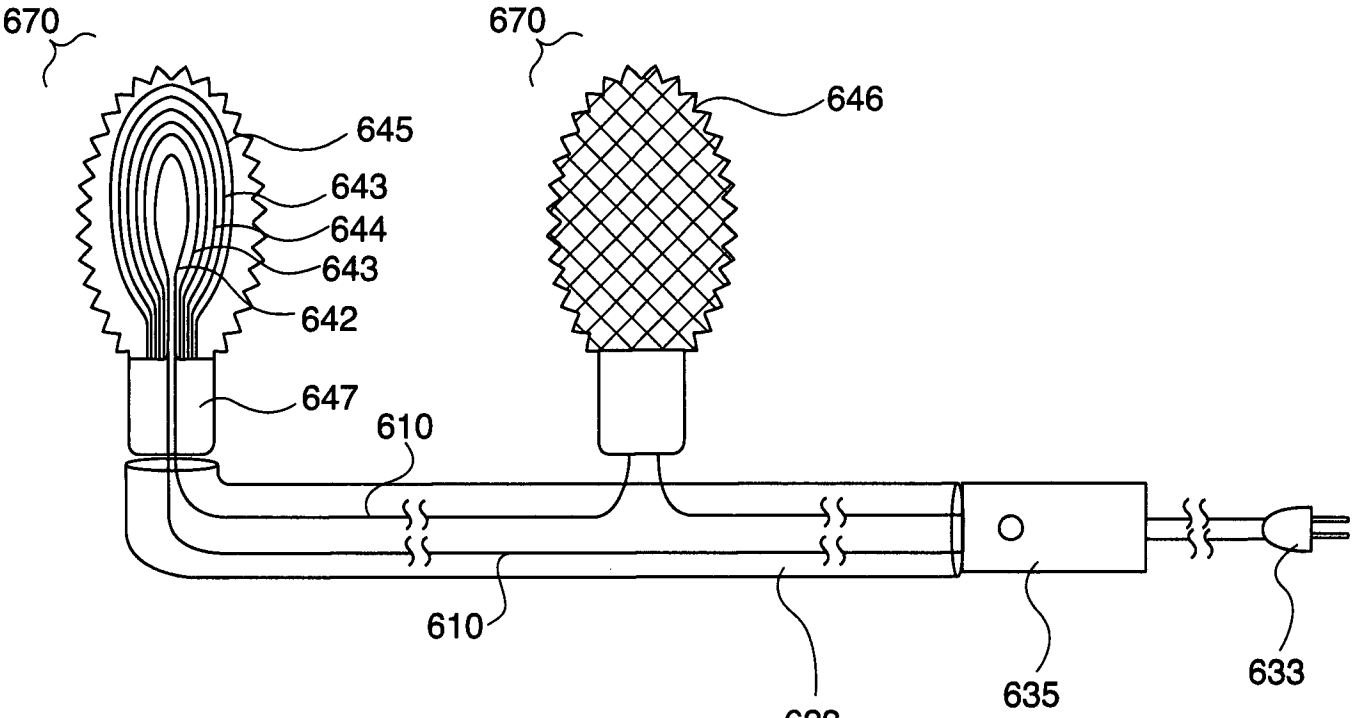
FIG. 9 shows another system of coupled, lighted ornaments which are coupled to a controller according to one embodiment of the invention.

In FIG. 9, smaller, bulb-shaped ornaments 670 are shown as part of a light string 623 (i.e. wiring harness). The EL light "bulbs" have similar component parts as the ball ornaments provided in FIGS. 1 and 2 including a plurality of coatings or layers 643, 644, 645 and 646 as shown to be deposited sequentially on the base conductor 642. In the above-described fashion, controller 635 is coupled to AC power through plug 633 and after low voltage rectification and EL signal generation, passes the EL activation signals on leads 610 to the EL bulb ornaments 670.

Figure 10A:
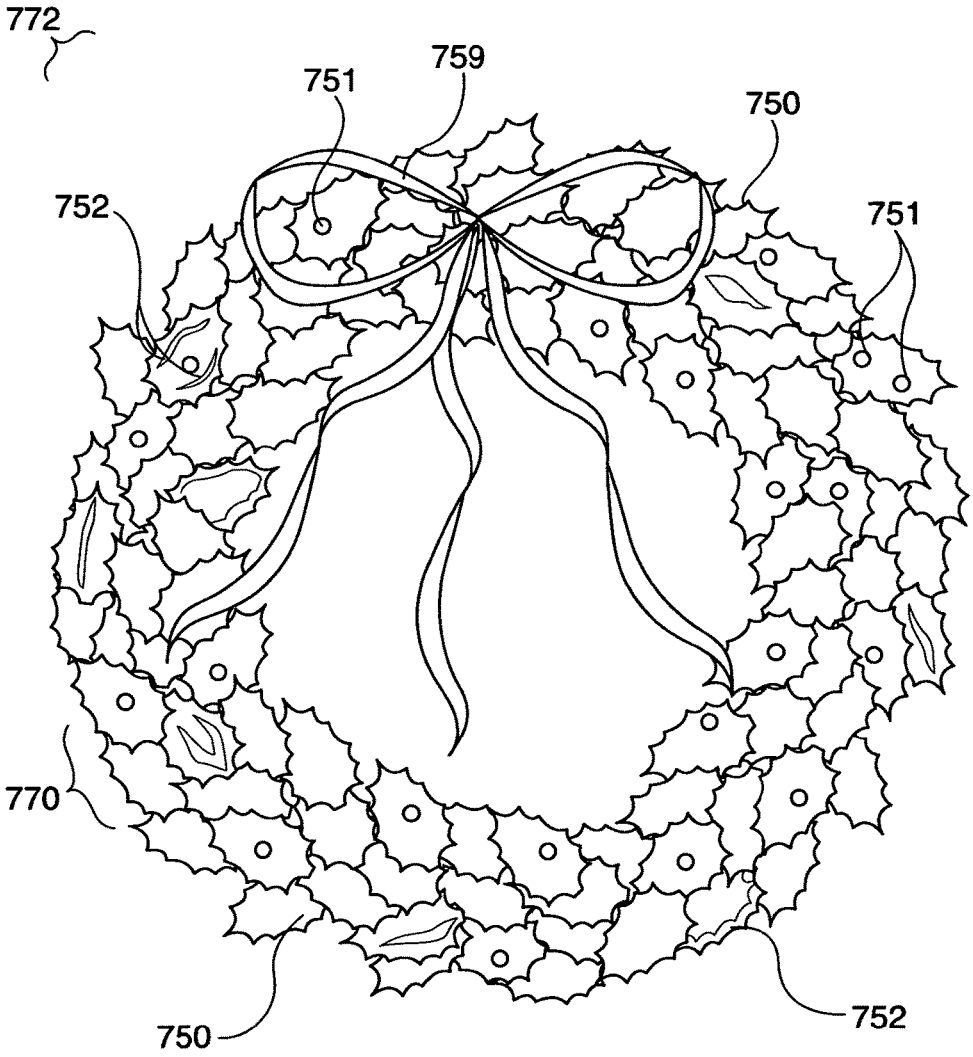
FIGS. 10A-10C show a system of coupled lighted elements assembled as a holiday wreath according to one embodiment of the invention.
Figure 10B:
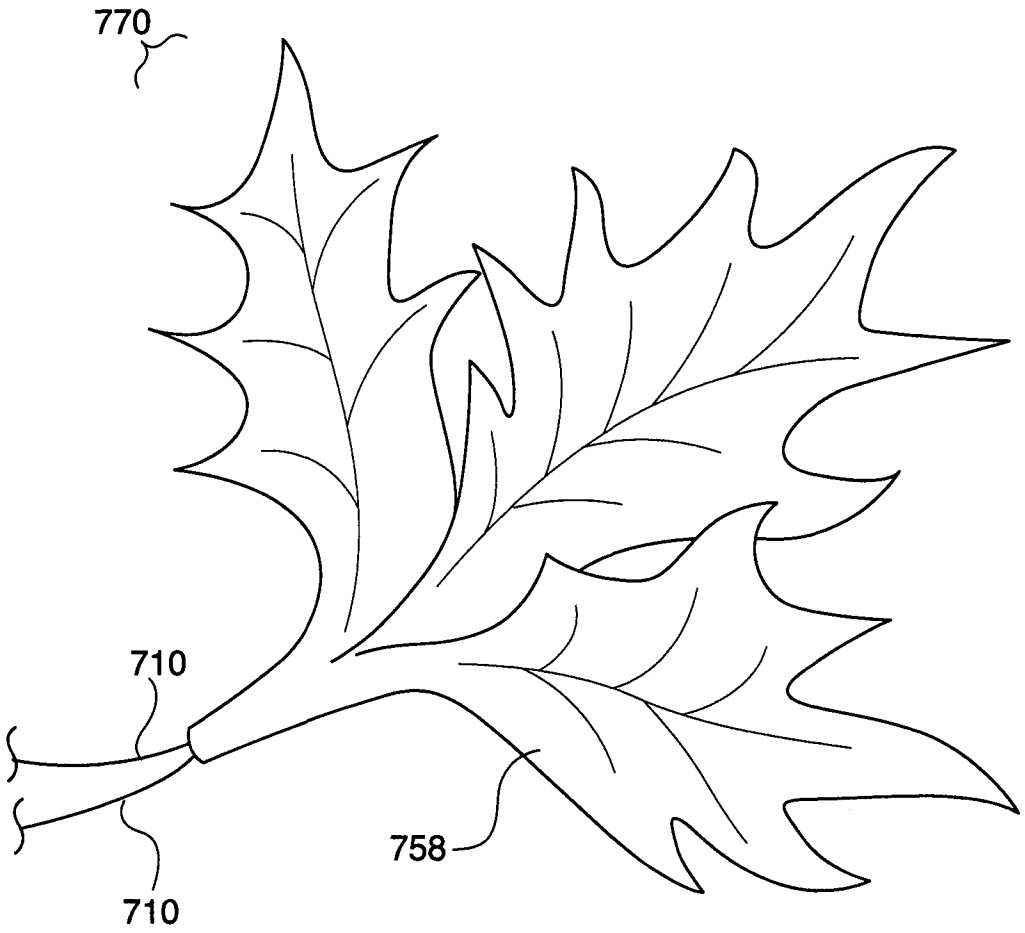
Figure 10C:
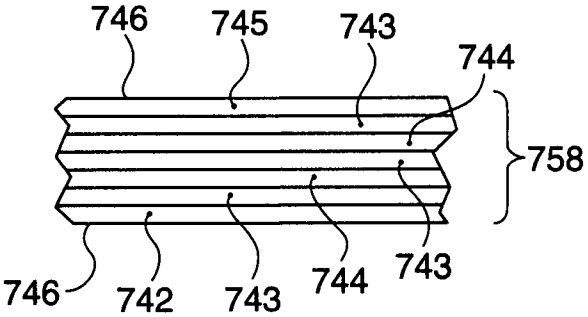

FIGS. 10 A and 10B show another prototypical holiday lighting system 772 as a wreath. Within the wreath, EL ornaments include individual leaf elements of the wreath 770 and decorative ribbons 759. Alternative lighting elements, such as berries in red LEDs 751 and green LEDs 752 may also be provided within the overall display. As shown in FIG. 10B, individual EL leaf elements 770 are singular EL lighted elements controlled by EL control leads 710. Referring to FIG. 10C, the composition of the EL leaves (and the ribbon, although not shown in the Figures) is analogous to that described in FIG. 1 where a plurality 758 of coatings or layers 743, 744, 745 and 746 are deposited on one or both sides of the base conductor 742 which may itself be deposited on one or both sides of a rigid leaf support. It should be realized that in alternative arrangements of the above layering, such as shown in FIG. 10 C, the EL, insulating, and first and second conductor layers may be rearranged as needed for convenience and economy within the operational constraints of the EL lighting technology. In FIG. 10C, for example, EL layers 744 (possibly including different colors, e.g. green/red) are in the middle of the sandwich structure, on and in between which insulating layers 743 are deposited. On one side of the leaf, the base conductor 742 is deposited while on the other side of the leaf the second conductor 745 is deposited, upon which additional insulation layers and/or sealing layers 746 may be applied. Similar construction principles apply to other elements of the EL wreath ornament such as the EL ribbon 759.

[SIC] With respect to lighting system control devices, numerous variations and configurable options are envisioned as being useable with the aforementioned EL lighting systems. Different lighting systems having differing voltage requirements that may need to be accommodated within an EL integrated lighting system. With respect to stylized lighting, certain features and functions may be more or less desirable given the nature of the EL ornaments and the overall EL lighting display. For example, large EL lawn ornamental displays may be interconnected with intervening controllers programmed to mimic a sequence of lighting from another source. The source may be another EL display ornament, or an LED string, or an incandescent bulb or any other light source. Optical detectors, in combination with wireless connectivity means including cell phone applications, may be used to convey signaling in place of hardwired control leads. Ornaments and display designs having multiple colors and patterns, of complex shapes and color patterns may benefit from specialized color sequencers such as those disclosed in the All Holiday patent application referenced above.

Figure 11A:
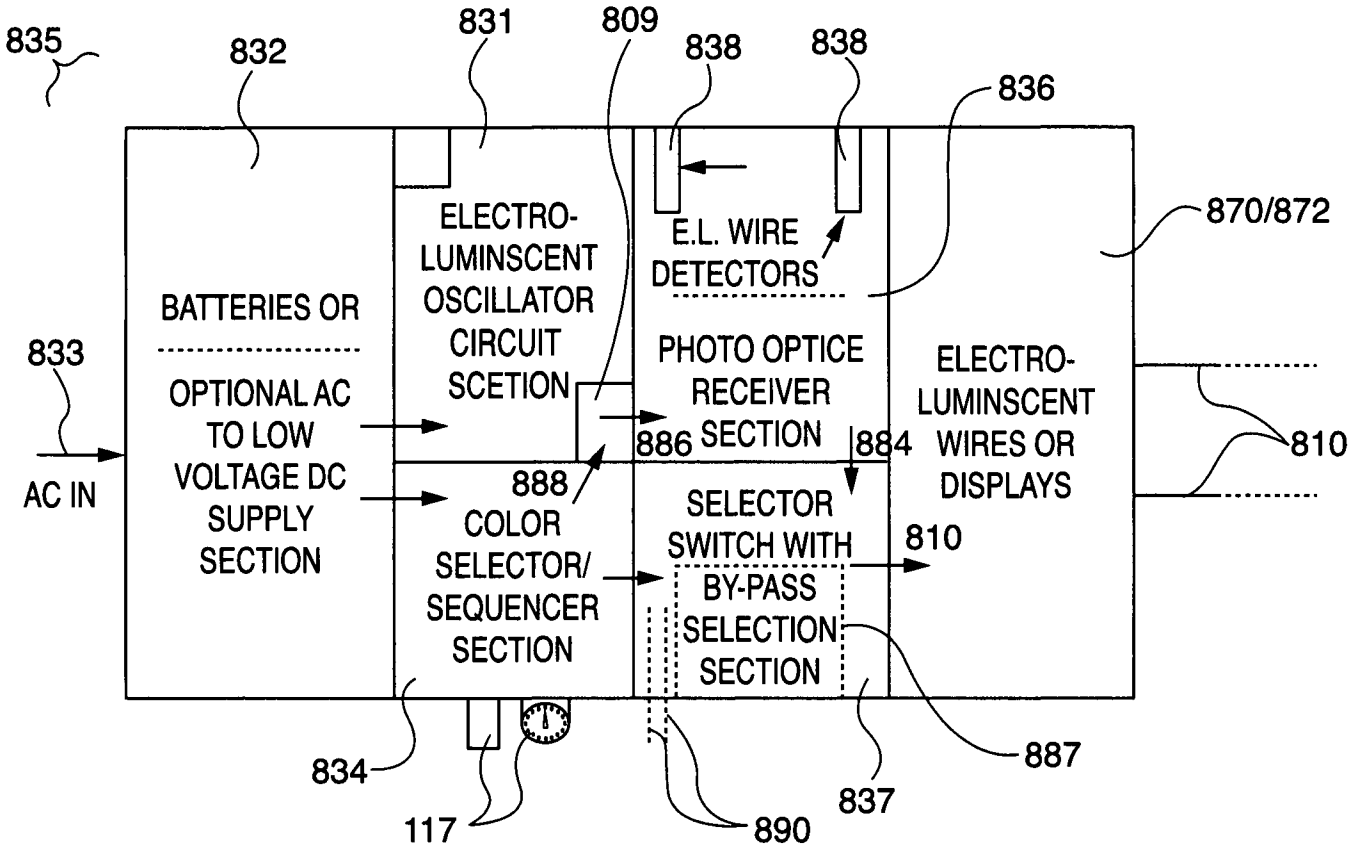
FIGS. 11A & B show one embodiment, including some variations, of the power and control system used in connection with the ornaments, lights and lighted display systems of the invention.

FIG. 11A shows one example of a sophisticated EL controller 835. Controller 835 has an AC plug 833 that provides input AC power to: the controller, its circuitry and any EL ornaments and displays controlled by it. AC/DC rectification section 832 rectifies the AC input power to DC power for providing power to other sections of the controller and the EL lights. In alternative embodiments, the AC/DC rectification section also provides battery: supplied or battery backed-up power to the same downstream power consuming elements. EL oscillator circuit section 831, containing oscillator 809, is powered by the DC power from AC/DC rectification unit 832 and outputs a biasing oscillation signal (AC signal) 886 to the photo optical receiver section 836. Photo optical receiver section receives photo detection signals from photo optic receiver 139 (see FIG. 4) and employs switching circuitry or software to condition that signal receipt and pass the biasing oscillation signal on to the selector switch section 837 under select conditions. If a simple optical on/off sensing function is being implemented, the photo optic receiver section will pass a positive biasing signal on when the photo optic sensor 139 is energized. When operating as a more sophisticated color illumination sensor, the photo optic receiver section 836 will receive actual color information on leads 838 and the photo optic receiver section will pass appropriate color biasing signal(s) to the selector switch section 837 depending on the color(s) detected.

Color selector and sequencer section 834, also powered by AC/DC rectifier section, contains user operable controls to make color selections that are to be displayed on the EL lights. Simple on/off or other sophisticated color selections (e.g. the Rotary Switch application) may be based on a simple, externally mounted switch or dial 117: Other more sophisticated selection mechanisms, i.e. computer-based or touch displays, wireless access etc., may be required to effectuate more complicated power and color selection schemes such as those presented in the All Holiday application. Further, color selector and sequencer section optionally has circuitry and or programmable software for controlling 888 the variable frequency oscillator 809 so as to enhance or diminish the EL color display intensity. Finally, color selector and sequencer section optionally has the programmed control capability to provide start delays, following delays, repetitive patterns, and other light sequencing adjustments that may be desirable in the illumination of the EL ornaments.

Selector switch section 837, in any case, acts as the overall switch controller. Selector switch section 837 takes in all powering and color selection signals 884 from photo optic receiver section 836 and color selector and sequence section 834 and provides a master switching function output, i.e. activation of the EL lighting based on the inputs. The switching function within selector switch section 837 is preferably implemented in computer-based hardware, software or both. Selector switch section 837 accepts all input powering/control signaling and provides output EL control signaling on leads 810 out to all coupled EL wires, displays and downstream-controlled apparatus. Selector switch section 837 may optionally contain a By-Pass selection section 887 which, when activated, ignores all but the powering/color signaling from the photo optic receiver section (or other general input signaling provided on in leads 890 from other attached light strings) such that the output EL signaling mirrors the powering/color section signals input to that section from the lead lighting input (838 or 890).

Figure 11B:
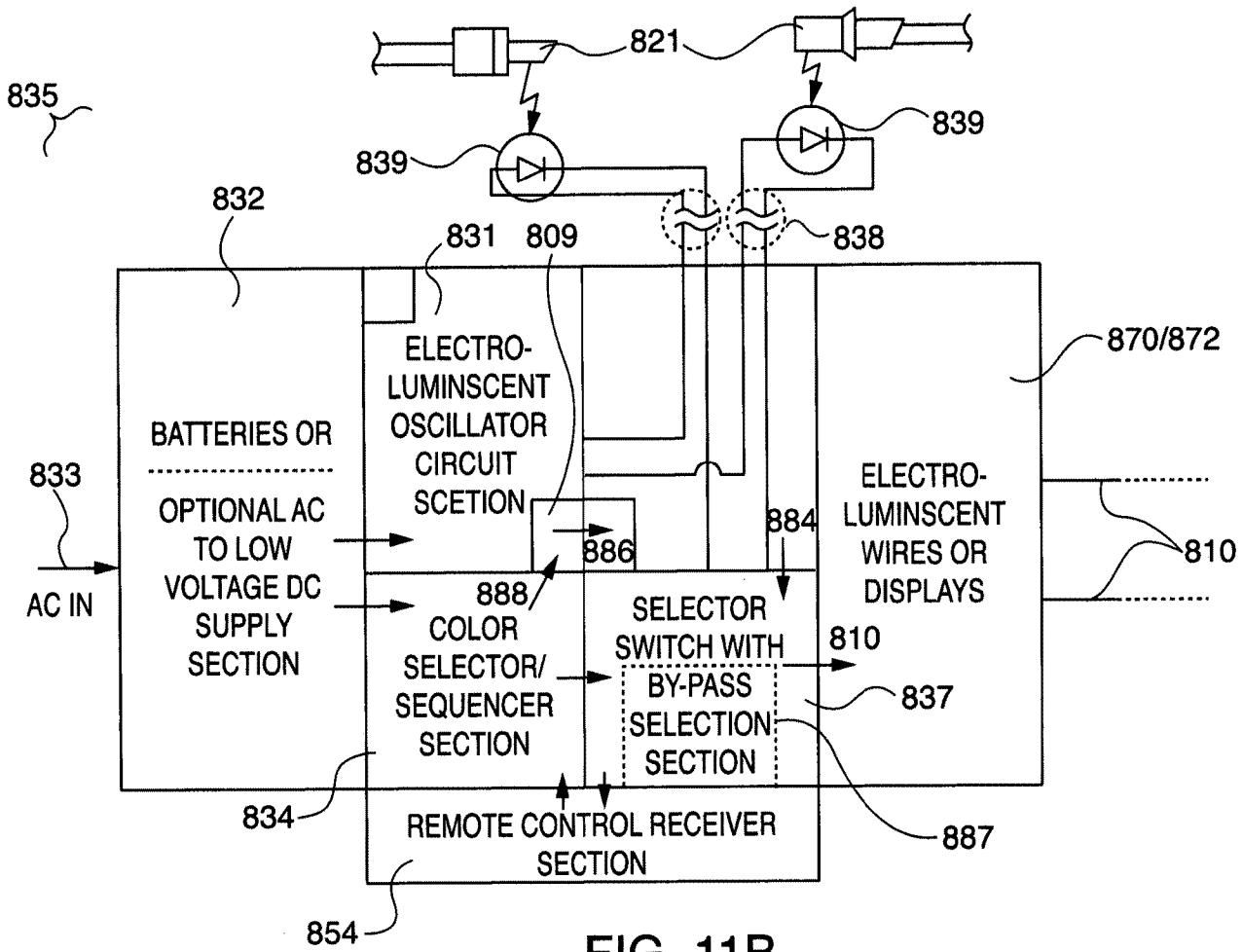

FIG. 11B is similar to FIG. 11A and shows a few additional elements. In particular remote control receiver section 854 is included as part of the controller 835 (also as shown in FIG. 2) for receiving wireless control signals and providing them to the color selection and sequencer section 834 and to the By-Pass selection section 887. Also shown are the actual photo optic receivers 839 coupled to signal leads 838 for detecting illumination and/or color information from external lighting elements 821, which may be LEDs or any other lighted element.

Figure 12:
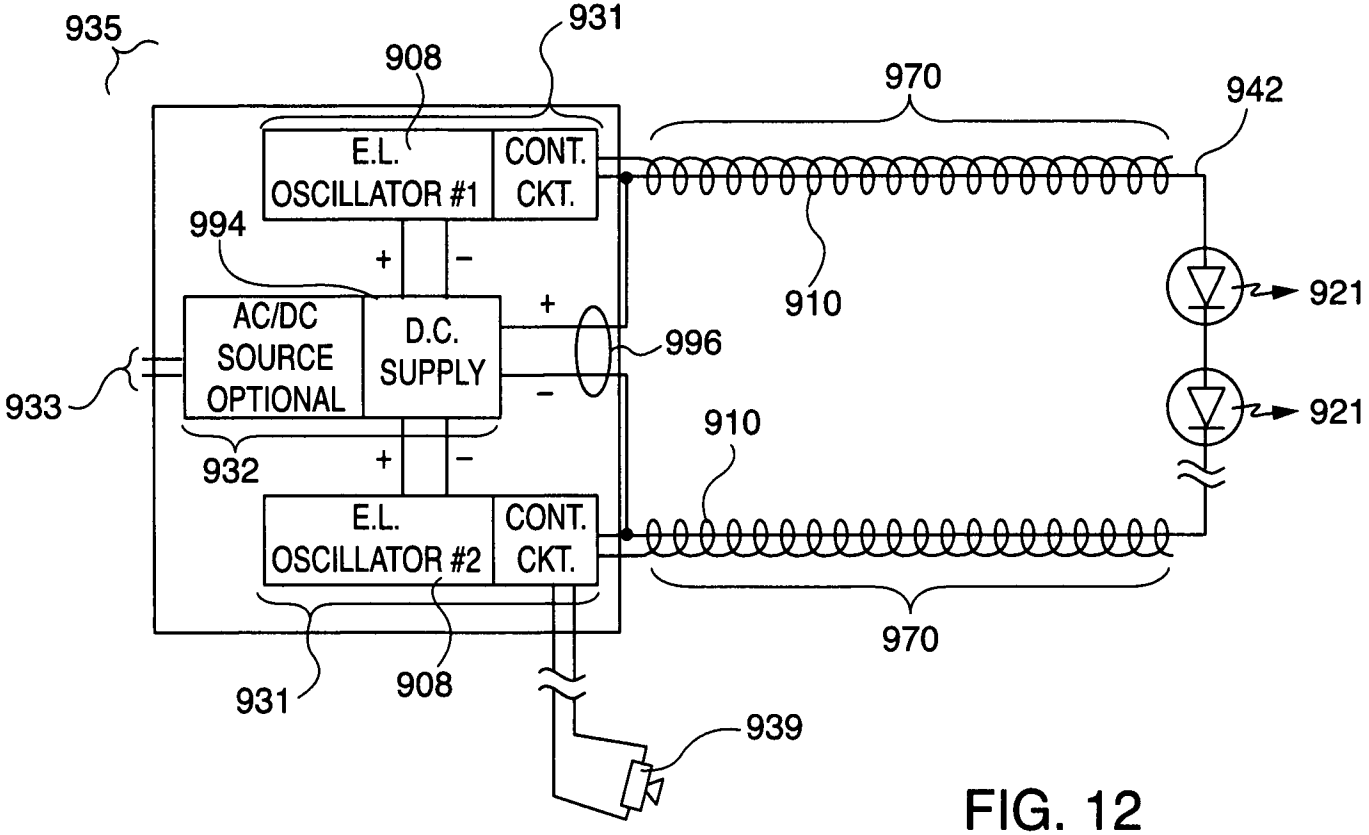
FIG. 12 shows another embodiment of the power and control system used in connection with the ornaments, lights and lighted display systems of the present invention.

FIG. 12 shows another example of a sophisticated EL controller 935 that is capable of powering and controlling both EL and LED lights simultaneously. Controller 935 has an AC plug 933 that provides input AC power which is subsequently rectified by AC/DC rectification section 932. The rectified DC power subsequently provides power to the remaining portions of the controller, its circuitry and any non-self-powered EL and LED ornaments and displays controlled by it. In rectifying the AC power, AC/DC rectification section 932 includes DC supply sub-module 994 which provides at least three DC output supplies: one to each of the two EL oscillator circuit sections 931 and the third for providing DC power output across the base conductors (996) of each of the two pairs of EL control leads 910 as output from EL oscillator control sections 931. At least two EL oscillator circuit sections 931 are included in controller 935 and contain oscillators 908. AC/DC rectification section 932 receive power from AC/DC rectification section 932 and provide controlled bias to EL control signal pairs 910 to activate EL ornaments 970. However, the base conductor of each of the two EL control signal pairs is also coupled to a DC rectified output from the DC supply sub-module 994. Therefore, these base conductors have a DC bias between them and between which LED lighting elements 921 may be connected (with proper polarities). Thus the DC bias provided on the pair of base conductors biases the LED lighting elements as well as providing AC bias on each of the EL signal pairs 910 so as to bias the EL lighting elements.

Although various embodiments, which incorporate the teachings of the present invention have been shown and described in detail herein, those skilled in the art can readily devise many other varied embodiments that still incorporate these teachings.

What is claimed is:

1. An ornament comprising:

a shell having a plurality of coatings applied to the shell, said plurality of coatings being layered on the shell and including a base conductor layer, an active conductor layer, and an electroluminescent layer disposed between the base conductor layer and the active conductor layer; and an electronics platform having a DC/AC converter and a DC power supply, the DC power supply coupled to the DC/AC converter, and the DC/AC converter having a first lead electrically coupled to the base conductor layer and a second lead electrically coupled to the active conductor layer, the electroluminescent layer being illuminated when the DC power supply is in an active state;

wherein the electroluminescent layer includes a plurality of portions; and wherein each of the plurality of portions is coated with a different color electroluminescent material.

2. The ornament of claim 1, wherein the plurality of coatings includes a first insulating coating disposed between the base conductor layer and the electroluminescent layer, and a second insulating coating disposed between the electroluminescent layer and the active conductor layer.

3. The ornament of claim 1, wherein the plurality of coatings includes an outer protective coating encasing the plurality of coatings between the shell and the outer protective coating.

4. The ornament of claim 1, wherein each of the plurality of portions is a different-colored, wedge-shaped portion disposed along the shell.

5. The ornament of claim 1, wherein each of the plurality of portions is a different-colored, vertically-oriented, wedge-shaped slice disposed along the shell.

6. The ornament of claim 1, wherein the active conductor layer is a fine wire weave layer.

7. The ornament of claim 2, wherein the first and second insulating coatings are clear coatings.

8. The ornament of claim 1, wherein the ornament is a Christmas ornament and the shell is a Christmas ornament shell.

9. A lighting device, comprising:

a base conductor;

a first insulating layer disposed on the base conductor;

an electroluminescent layer disposed on the first insulating layer;

a second insulating layer disposed on the electroluminescent layer; and an active conductor layer disposed on the second insulating layer;

wherein the electroluminescent layer includes a plurality of portions; and wherein each of the plurality of portions is coated with a different color electroluminescent material.

10. The lighting device of claim 9, wherein the lighting device is a branch of a decorative artificial tree.

11. The lighting device of claim 9, wherein the lighting device is selected from the group consisting of a needle of an artificial Christmas tree, a leaf of an artificial holiday wreath, and a leaf of an artificial holiday tree.

12. The lighting device of claim 9, wherein the lighting device is a branch of a decorative artificial tree.

13. The lighting device of claim 9, further comprising an electrical converter having a first lead and a second lead, the first lead being electrically connected to the base conductor and the second lead being electrically connected to the active conductor layer.

* * * * *